United States Patent [19]

Guidosh

[11] 4,107,637

[45] Aug. 15, 1978

[54] NO-LOAD TAP CHANGER FOR THREE-PHASE TRANSFORMERS

[75] Inventor: Edward F. Guidosh, Hubbard, Ohio

[73] Assignee: Westinghouse Electric Corp., Pittsburgh, Pa.

[21] Appl. No.: 763,208

[22] Filed: Jan. 27, 1977

[51] Int. Cl.[2] ..... H01F 21/12; H01H 3/00

[52] U.S. Cl. ..... 336/150; 200/11 TC; 200/18

[58] Field of Search ..... 336/150; 323/43.5; 200/18, 11 TC, 153 P

[56] References Cited

U.S. PATENT DOCUMENTS 3,155,782 11/1964 Wilson, Jr. ..... 200/11 TC

*Primary Examiner*—Thomas J. Kozma

*Attorney, Agent, or Firm*—William M. Hanlon, Jr.

[57] ABSTRACT

Tap changing apparatus for switching the turns ratio between the primary and secondary windings of a three-phase transformer. The tap changer includes three mounting boards, one for each phase of the transformer. Each board contains a plurality of stationary contacts arranged in a circular pattern around an axis of rotation and connected to taps from various sections of the transformer windings. A movable contact assembly is associated with each set of stationary contacts and is rotatable around the center axis of each respective contact set. Each movable contact assembly is affixed to a worm gear which operates to rotate the movable contacts between successive stationary contacts in each respective contact set. Separate worms, which mesh with each respective worm gear, are connected along a common axis by a series of insulated shafts, which link the worms with an operating handle mounted outside the transformer enclosure, such that movement of the operating handle causes all three worms to rotate thereby switching the movable contacts between successive stationary contacts.

7 Claims, 5 Drawing Figures

NO-LOAD TAP CHANGER FOR THREE-PHASE TRANSFORMERS

BACKGROUND OF THE INVENTION

1. Field of the Invention

This invention relates in general, to electrical inductive apparatus and, more specifically, to three-phase transformers utilizing no-load tap changers.

2. Description of the Prior Art

No-load tap changers are used to provide a range of output voltages for transformers. Such transformers contain a series of connections or taps from various sections of either the primary or secondary winding such that a different number of turns of the winding are provided at each tap. Conventional no-load tap changers, which operate when the transformer is de-energized, include a plurality of stationary contacts, each connected to a different tap on the winding, and a contact assembly which can be moved to engage any one of the stationary contacts; thereby changing the turns ratio between the primary and secondary windings and altering the output voltage of the transformer. No-load tap changers for three-phase transformers have separate sets of stationary and movable contacts for each phase of the transformer. The movable contacts are usually connected together such that they may be rotated simultaneously.

As most no-load tap changers are mounted within the main transformer enclosure, there is a continuing need to minimize the size of such tap changers and thereby reduce the overall size and weight of the transformer itself. One of the main areas of concern, and one that consumes the most space in a tap changer, is the drive means used to switch the movable contacts between successive stationary contacts.

One type of drive means, known in the prior art, positions the axis of rotation of the operating force, operative from outside the transformer enclosure, parallel to the axes of rotation of the movable contacts in each phase of the tap changer. Tap changers utilizing this type of drive means are extremely large since the aligned connections between the operating force and the movable contacts require the circular arrangement of stationary contacts to be mounted perpendicular to the side of the core and coil assembly of the transformer.

As a means of reducing the space consumed by the tap changer within the transformer enclosure, it is known to position the tap changer above the case and coil assembly such that the circular arrangement of stationary contacts is parallel to the horizontal axis of the core and coil assembly. In such an arrangement, the movable contacts and the operating handle usually have different planes of rotation. A drive means, typically comprised of level or spur gears, and a motion transmitting means are used to translate motion between the different planes of rotation of the tap changer.

For example, in U.S. Pat. No. 3,396,248, issued to G. A. Wilson, Jr., the rotary operating force is translated to a different plane by a drive means comprised of level gears, which is connected to a motion transmitting means, consisting of level gears, at each phase of the tap changer, which further translate the rotary motion to the third non-aligned plane of rotation of the movable contacts.

Similarly, in a co-pending application, Ser. No. 599,241, now U.S. Pat. No. 4,013,847, in the name of E. Guidosh and assigned to the present assignee, the rotary operating force applied from outside the tank is translated by a rack and pinion drive means to linear movement of an operating mechanism, mounted in a different plane; which linear movement is further translated to rotary motion of the movable contacts by individual rack and pinion gears at each phase of the tap changer.

Similarly, in another co-pending application, Ser. No. 732,635, filed Oct. 15, 1976, now U.S. Pat. No. 4,035,717, in the name of E. Guidosh and assigned to the present assignee, a drive means comprised of a worm and worm gear translates motion to circular members at each phase of the tap changer, which are linked by a connecting member and which replace the individual rack and pinions of the previously cited application.

Regardless of the particular gear used in each type of tap changer, the same result is obtained; namely, the rotary operating force applied in one plane is translated to rotary motion of the movable contacts, mounted in a different plane, by a single drive means and individual motion transmitting means associated with each phase of the tap changer.

Although satisfactory in operation, tap changers with this type of linkage utilize large and rigid drive and connecting members to insure that the gear sets are properly aligned and also to withstand the forces involved in switching all three phases of the tap changer. In addition, backlash, inherent in all gear sets, necessitates that the stationary contact structures be enlarged to compensate for the buildup of tolerances along the gear drive train and to insure adequate engagement of the stationary and movable contacts.

Thus, further improvements and size reductions in no-load tap changers are still desirable and it is an object of this invention to provide a no-load tap changer for three-phase transformers which is smaller and more economical than tap changers known in the prior art and also to provide a no-load tap changer which will enable significant economics to be made in the design of the transformer itself.

SUMMARY OF THE INVENTION

Disclosed herein is a novel, no-load tap changer suitable for use with three-phase transformers. The tap changer includes three mounting boards, one for each phase of the transformer, which are mounted parallel to the side of the core and coil assembly. Each board contains a plurality of stationary contacts arranged in a circular pattern around an axis of rotation and connected to taps from various sections of the transformer winding. A movable contact assembly is associated with each set of stationary contacts and is rotatable around the center axis of each respective contact set. Each movable contact assembly is affixed to a worm gear which operates to rotate the movable contacts between engagement of successive stationary contacts. Individual worms, which mesh with respective worm gears, are coupled by a series of insulated shafts which link the worms to an operating handle mounted on the outside of the transformer enclosure; such that rotation of the operating handle will cause all three worms to rotate and thereby switch the movable contacts between successive stationary contacts.

By utilizing individual drive mechanisms for each phase of the tap changer, as shown in the present application, instead of one main drive unit; significant, non-obvious economies are obtained. The individual gear sets used to rotate the movable contacts between successive stationary contacts can be made smaller and therefore less costly, since less force is required to rotate one movable contact assembly than that required to switch all three movable contacts. This arrangement also reduces the total amount of backlash present in the drive mechanism since the backlash in each gear set is not passed along to successive gear sets; but instead, is isolated in each phase of the tap changer. The stationary contact structures may, therefore, be reduced in size since the movement of each movable contact assembly is more precise.

Due to the size reductions thus obtained, the tap changer may be mounted such that the plane of rotation of the movable contacts is parallel to the side of the transformer core and coil assembly which provides additional advantages, particularly with core-type transformers. In such a transformer, it is convenient to bring the tap leads out of the side or middle of the core and coil assembly. The distance between the taps and the stationary contacts of the tap changer, mounted on the side of the core and coil assembly, is thereby reduced, resulting in a reduction or complete elimination of the cables normally required to connect the tap leads to the stationary contacts of the tap changer. Thus, material and labor savings are realized, which when coupled with additional coolant and support structure savings, results in a significant reduction in the overall cost, size, and weight of a three-phase transformer.

BRIEF DESCRIPTION OF THE DRAWINGS

The various features, advantages, and other uses of this invention will become more apparent by referring to the following detailed description and drawing, in which.

DESCRIPTION OF THE PREFERRED EMBODIMENT

Throughout the following description, similar reference numbers refer to similar components in all figures of the drawings.

Figure 1:
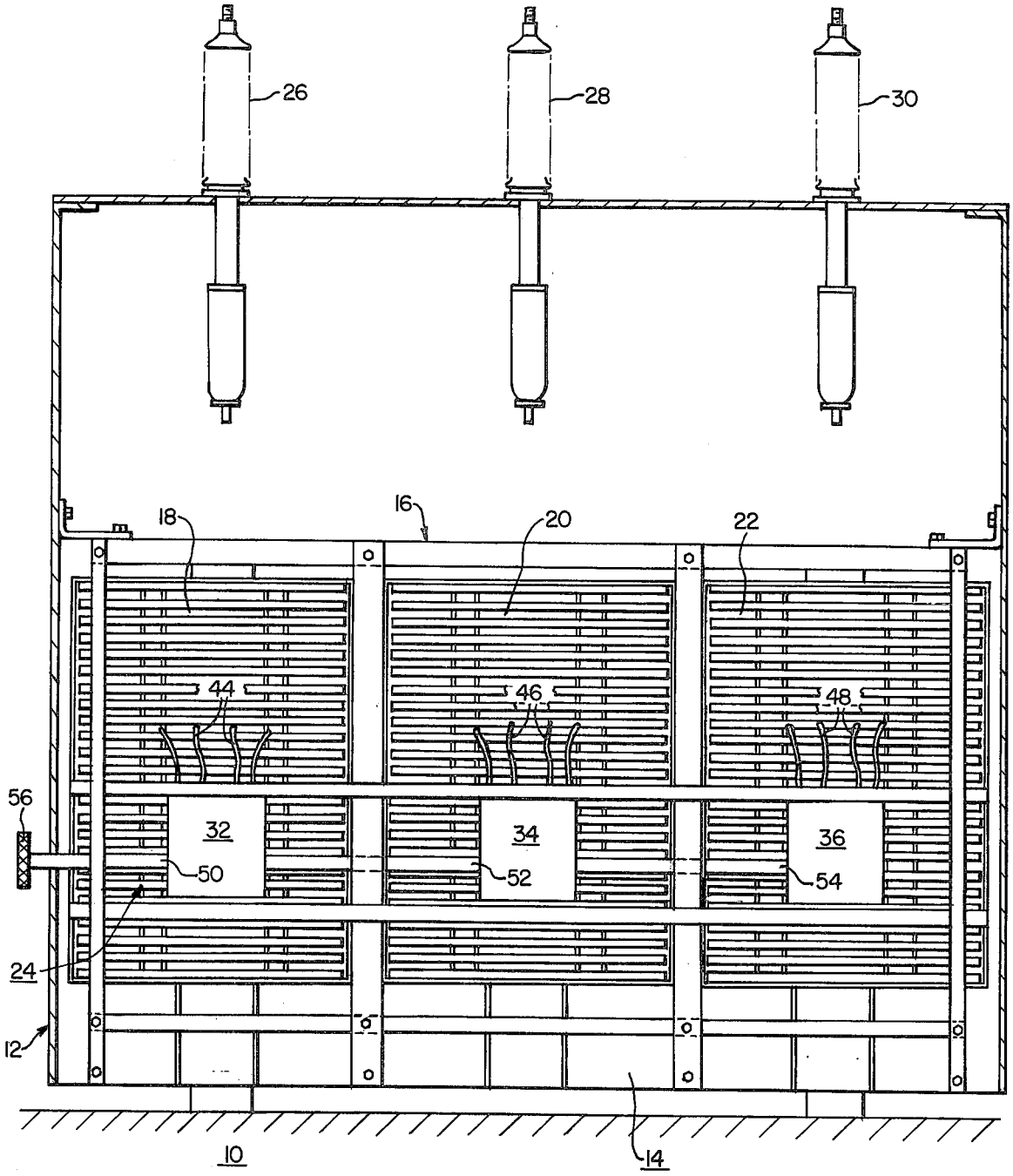
FIG. 1 is an elevational view of a three-phase transformer and no-load tap changer.

Referring now to the drawings, and to FIG. 1 in particular, there is shown a three-phase transformer utilizing a no-load tap changer constructed according to the teachings of this invention. The transformer 10 consists of a magnetic core and coil assembly 14 wherein phase windings 18, 20 and 22 are disposed in inductive relation with a three-phase magnetic core 16. The magnetic core and coil assembly 14 has a cubical form wherein the sides form vertical planar, exterior surfaces, and the top and bottom form horizontal, planar, exterior surfaces. A sealed case 12 surrounds the magnetic core and coil assembly 14 and the tap changer 24 and also provides support for bushings 26, 28 and 30 which are normally connected to electric leads, not shown, extending into the transformer windings 18, 20 and 22.

The tap changer 24 consists of an insulating means, which, according to the preferred embodiment, is comprised of mounting boards 32, 34 and 36 which are attached to the magnetic core and coil assembly 14 by suitable support structure. The mounting boards 32, 34 and 36 contain contact sets 38, 40 and 42, respectively, each of which includes a plurality of stationary contacts and a single movable contact assembly. A series of tap leads 44, 46 and 48 are brought out from the various sections of each transformer winding 18, 20 and 22, respectively, and are connected to the appropriate stationary contacts in each respective contact set 38, 40 and 42. Connecting members 50, 52 and 54 extend between each mounting board 32, 34 and 36 and link the individual movable contact assemblies with an operating means or handle 56 which is mounted outside of the transformer enclosure 12. Movement of the operating handle 56 in turn rotates the movable contact associated with each phase of the tap changer 24 to engage successive stationary contacts in each respective contact set 38, 40 and 42.

Figure 3:
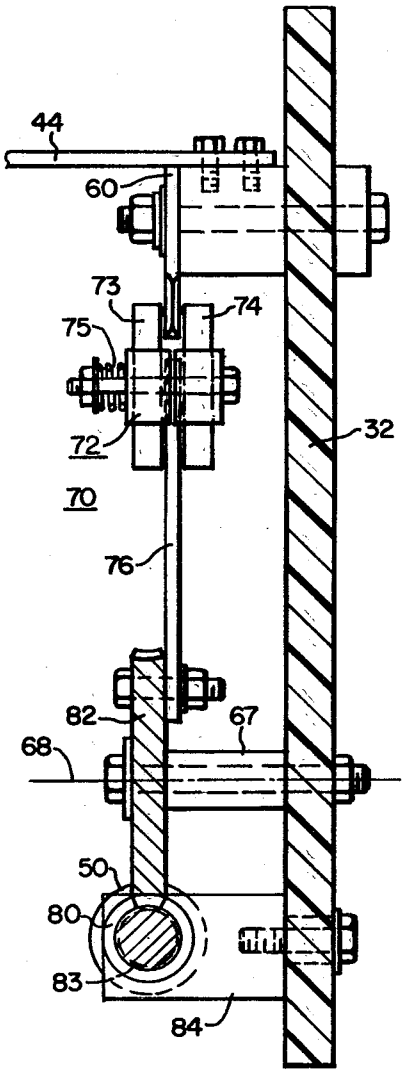
FIG. 3 is a sectional view of one of the tap changer drive mechanisms, generally taken along line III—III in FIG. 2.
Figure 2:
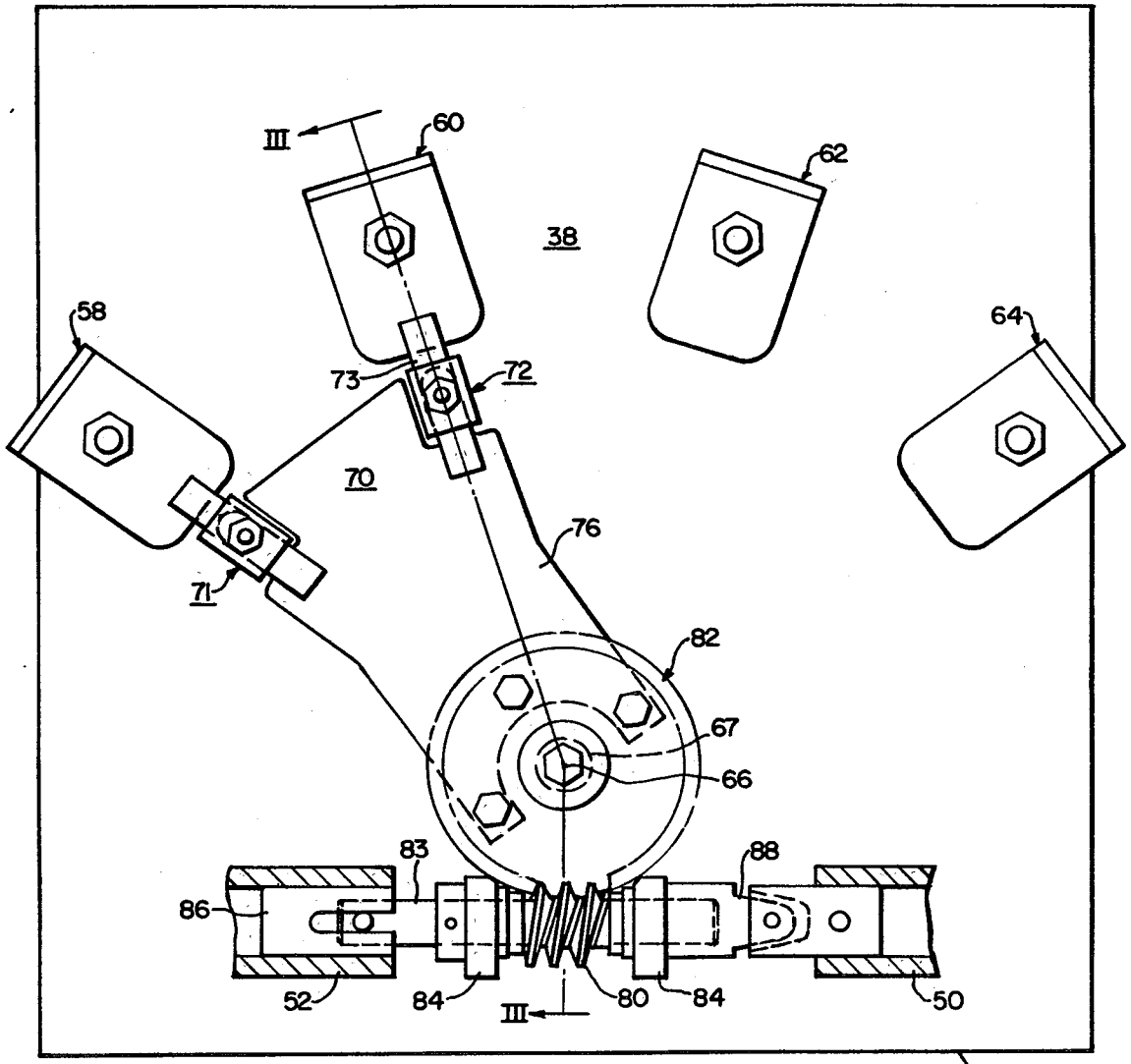
FIG. 2 is an elevational view of one of the identical tap changer drive mechanisms.

FIG. 2 is a view of one of the mounting boards, generally taken from the back of such board showing the contact structure and drive mechanism. Since the drive mechanism and contact structure on mounting board 32, 34 and 36 is similarly constructed, only one board will be described in detail below. Thus, FIG. 2 shows mounting board 32 which contains contact set 38. Contact set 38 consists of stationary contacts 58, 60, 62 and 64 arranged in a circular or arcuate pattern and equidistant from a center point 66 through which an axis of rotation 68 extends. It can be appreciated that any number of stationary contacts with any desired spacing could easily be substituted for the arrangement shown in the preferred embodiment. Each stationary contact 58, 60, 62 and 64 is suitably fastened to the mounting board 32 and is connected to a section of the transformer winding 18 by one of the tap leads 44, as shown in FIG. 3.

Associated with contact set 38 is a movable contact assembly 70 adapted for rotation around the axis of rotation 68 of the contact set 38. According to the preferred embodiment, the movable contact assembly 70 engages two adjoining stationary contacts, thereby electrically bypassing a portion of the transformer winding 18 and changing the number of turns of the winding 18 connected to the electrical potential across the transformer. Other arrangements for changing the turns ratio of the transformer could easily be substituted for the method shown in the preferred embodiment; such as one wherein the movable contact, itself, is connected to a tap on the transformer winding or that described below in the alternate embodiment of this invention.

Accordingly, in the preferred embodiment, the movable contact assembly 70 contains an arm 76 and two identical contacts 71 and 72 which are adapted for engaging stationary contacts 58, 60, 62 and 64 of contact set 38. As shown in greater detail in FIG. 3, each contact 71 and 72 contains two electrically conductive elements 73 and 74, hereafter referred to as metallic bars or fingers. Disposed between a portion of the fingers 73 and 74, and in contiguous relation therewith, is one end of arm 76 which forms a conductive path for the flow of electrical current between the fingers 73 and 74 of the contacts 71 and 72. The fingers 73 and 74 and the arm 76 are held in fixed relation by a suitable fastener which also includes a spring 75 to bias fingers 73 and 74 together and provide the requisite contact pressure between the fingers 73 and 74 and the arm 76. The spring 75 also provides a resilient force to the fingers 73 and 74 which enables them to easily engage or disengage the stationary contacts while still providing sufficient contact pressure between the fingers 73 and 74 and each stationary contact. The opposing end of the arm 76 is suitably fastened to a drive means which, according to the preferred embodiment, is comprised of a worm 80 and a worm gear 82. The worm gear 82 is rotatably affixed to a shaft 67 which is secured to the mounting board 32, and operates to rotate the movable contact assembly 70 between successive engagement of stationary contacts 58, 60, 62 and 64. The worm 80 is mounted on a shaft 83 which is journalled in a frame 84 secured to the mounting board 32, such that the worm 80 and the shaft 83 rotate together.

Although any type of gear set may be used to translate the motion between the non-intersecting and non-parallel axes of rotation of the operating handle 56 and the movable contact assembly 70, the worm 80 and worm gear 82 are utilized in the preferred embodiment since they offer a wider range of gear reduction ratios than other types of gear sets. Furthermore, the worm 80 and worm gear 82 require less vertical space from the mounting board 32 to translate motion between non-intersecting and non-parallel planes of rotation than other types of gear sets, which reduces the overall height of the tap changer and thereby decreases the size and weight of the transformer enclosure. The worm 80 and shaft 83, associated with contact set 38, are coupled to similar worms and shafts affixed to mounting boards 34 and 36 by a series of connecting members 50, 52 and 54 which are typically cylindrical bars or shafts. Each connecting member 50, 52 and 54 is constructed of an insulating material, such as one sold commercially under the tradename "Micarta", which serves to insulate the different electrical potentials of contact sets 38, 40 and 42 from each other and from the grounded operating handle 56. The shaft 83 can be attached to the connecting members 50 and 52 by any suitable type of fastening means; however, in the preferred embodiment, the connections are made in such a manner so as to allow for dimensional variations during construction. Thus, one end of shaft 83 is secured in an adjustable bracket 86 as shown in FIG. 2, which enables linear adjustments to be made in the distance between shaft 83 and the shaft on mounting board 34. Bracket 86 is in turn secured to connecting member 52 by suitable fasteners such that the shaft 83, bracket 86 and connecting member 52 rotate together as a unit. Similarly, the opposing end of shaft 83 is mounted in a universal joint assembly 88 which provides for vertical adjustment between the center lines of shaft 83 and the operating handle 56. The connections between connecting assemblies 52 and 54 and the shafts on mounting boards 34 and 36 utilize components identical to bracket 86.

Figure 5:
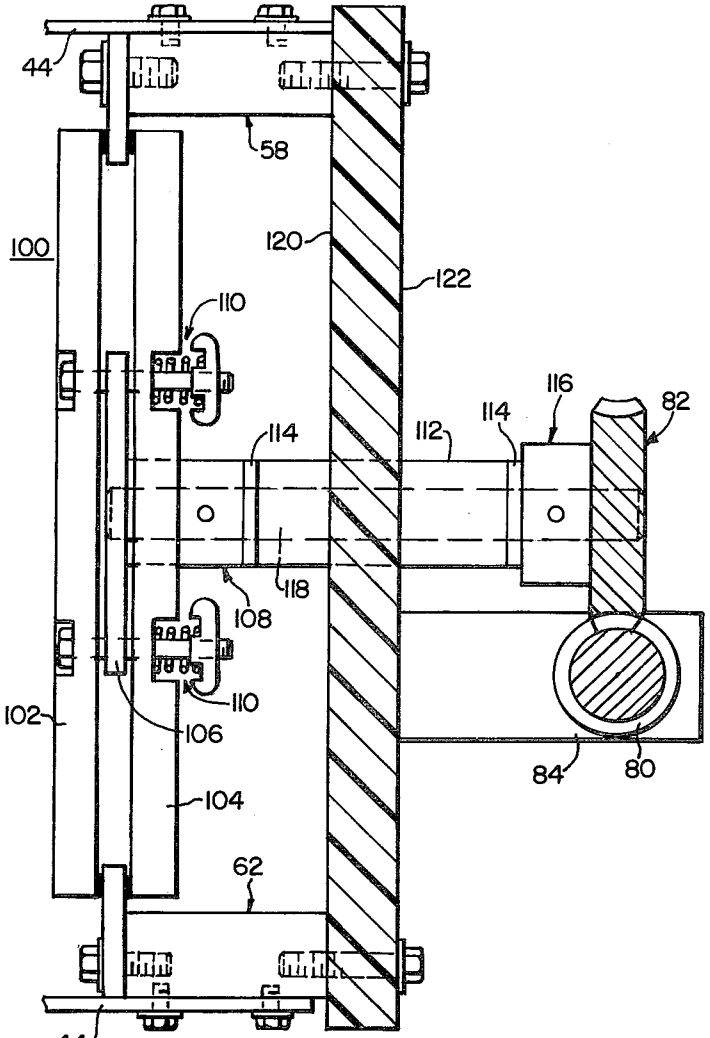
FIG. 5 is a sectional view of the alternate embodiment shown in FIG. 4, generally taken along line V—V in FIG. 4.
Figure 4:
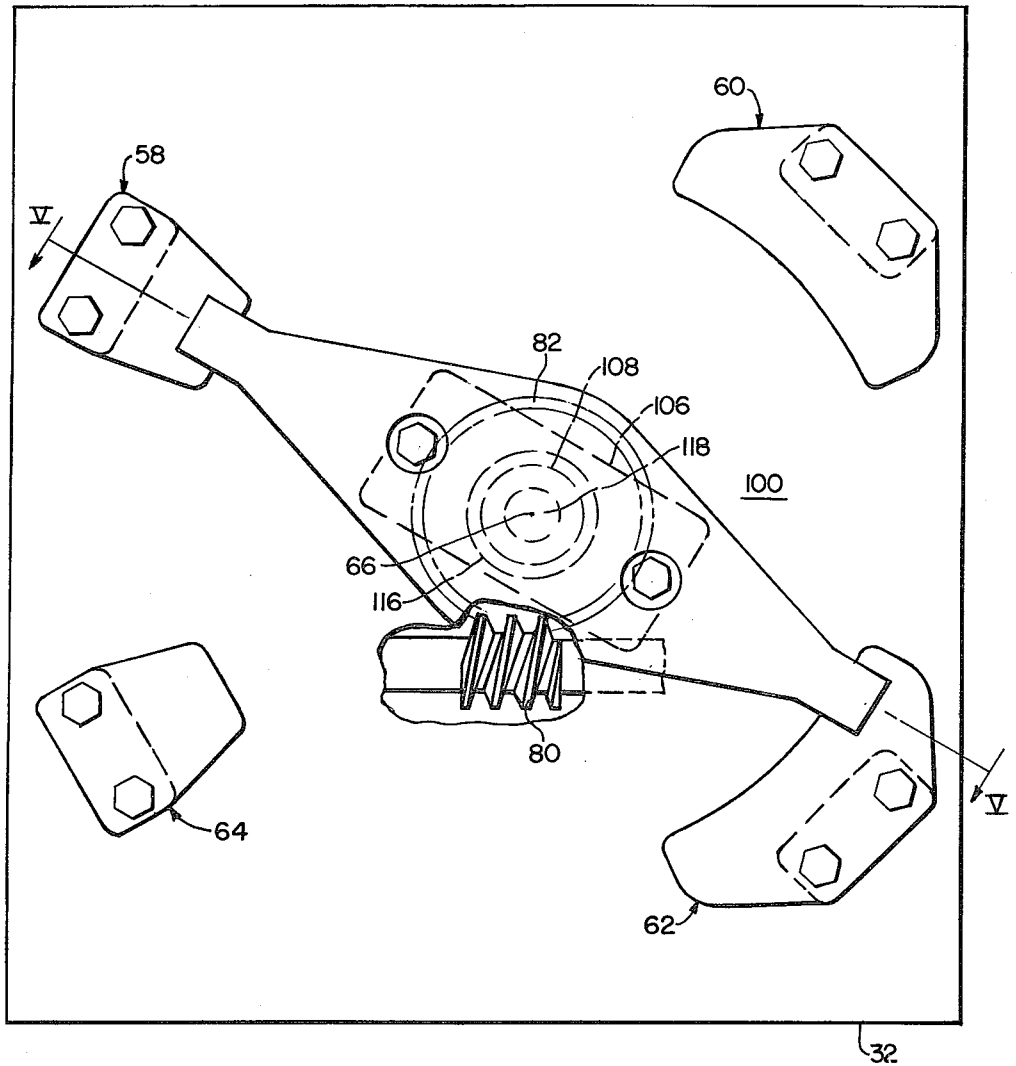
FIG. 4 is an elevational view of another embodiment of the tap changer drive mechanism.

FIGS. 4 and 5 illustrate another embodiment of the contact structure and drive mechanism wherein components that are identical in both this embodiment and the preferred embodiment have been given the same reference numbers. Specifically, FIG. 4 shows one of the identical mounting boards 32 on which is mounted, from a first side 120 of the board 32, a contact set 38 comprised of stationary contacts 58, 60, 62 and 64 arranged in a circular pattern around center part 66. Each stationary contact 58, 60, 62 and 64 is fastened to the mounting board 32 by suitable means as shown in FIG. 5.

Associated with contact set 38 is a movable contact assembly 100, adapted for rotation around the center point 66 of the contact set 38 and also mounted from the first side 120 of board 32. In this embodiment, the movable contact assembly 100 engages two stationary contacts that are disposed 180° apart in the contact set 38, such as contacts 58 and 62, and thereby electrically bypassing a portion of the transformer winding 18. The movable contact assembly 100 contains two arms 102 and 104 which are adaptable for engaging each stationary contact of the contact set 38. Holding the arms 102 and 104 in spaced relation is a spacer 106 which is fixedly secured to a rotatable shaft 108 such that movement of the shaft 108 causes rotation of the spacer 106. The spacer 106 and the arms 102 and 104 are held together by suitable means as shown in FIG. 5, and include springs 110 to bias arms 102 and 104 together and provide the requisite contact pressure between the arms 102 and 104 and each stationary contact.

The rotatable shaft 108 contains a pin 118, one end of which is journalled or otherwise fixedly secured inside shaft 108, such that both rotate together upon movement of the pin 118. The opposite end of the pin 118 is similarly journalled to bracket 116 and worm gear 82; thereby serving as a pivot point for the worm gear 82 such that rotation of the worm gear 82, as described in the preferred embodiment, causes the pin 118 and also shaft 108, spacer 106 and arms 102 and 104 to rotate.

Extending through the mounting board 32, and between the shaft 108 and the bracket 116 is a housing 112 which contains two bearings 114, the flanges of which are shown in FIG. 5. The bearings 114 allow the pin 118 to freely rotate within the housing 112 and thereby transmit the motion of the worm gear 82, mounted from the second side 122 of board 32, to the movable contact assembly 100. The connections between the individual worms on each mounting board 32, 34 and 36 and the operation of the drive mechanism is identical to that described in the preferred embodiment and, as such, will not be discussed here.

This embodiment of the tap changer positions the stationary contacts immediately adjacent to the points on the transformer coils where the tap leads are usually brought out. This not only simplifies assembly of the tap changer but also minimizes the rotating of the tap leads around other tap leads in order to connect them to the proper stationary contact, as is the case in the preferred embodiment.

In actual operation of both embodiments of this invention, the operating handle 56 will be rotated to change the tap settings in the transformer. This will impart a rotational movement to the connecting members 50, 52 and 54 and to the shaft and worm associated with each mounting board 32, 34 and 36, such as shaft 83 and worm 80 on mounting board 32. Rotation of the worms will turn the respective worm gears which mesh with the threads of each worm, thereby rotating each movable contact assembly to a different stationary contact in contact sets 38, 40 and 42.

As mentioned previously, the worm 80 and worm gear 82 provide reducing means such that the amount of rotation of the operating handle 56 is reduced to a proportionately smaller degree of rotation of each worm gear. In the preferred embodiment, the four stationary contacts in each contact set 38, 40 and 42 are positioned 36° apart from each other, although it is understood that other arrangements and spacings could easily be used. Thus, to rotate the movable contact assembly 70 36° between successive stationary contacts, such as between contacts 60 and 62, the worm 80 and operating handle 56 must rotate 720°, based on the 20:1 gear ratio between the worm 80 and worm gear 82 utilized in the preferred embodiment. In other words, two complete 360° revolutions of the operating handle 56 will rotate the movable contact assembly 70 to the next stationary contact.

Some of the advantages, realized by replacing the conventional, main drive gear set used in prior art tap changers with individual drive gear sets at each phase of the tap changer, as shown by the teachings of this invention, can now be more easily explained. As mentioned previously, prior art no-load tap changers utilize a single drive gear set and individual motion transmitting means to translate motion between the operating handle mounted outside the transformer enclosure and the individual movable contacts. The main drive gear set, the motion transmitting means and associated connecting members have to be designed large enough to generate sufficient force to switch all three movable contacts together. By placing individual drive mechanisms at each phase of the tap changer, the individual gear sets and connecting members can be made smaller, and therefore less costly, since each drive gear set is only switching one movable contact assembly which, obviously, requires less force than that required to switch all three movable contact assemblies.

Furthermore, the function of the main drive gear set and the individual motion transmitting means, normally used in prior art no-load tap changers, is reproduced by the individual drive mechanisms at each phase of the tap changer. Not only are these individual drive mechanisms smaller, they also reduce the number of components used in the tap changer which affords material and weight savings.

In addition, the backlash in the main drive gear set, used in prior art tap changers, is passed along to the remainder of the drive mechanism, thereby necessitating some enlargement of the stationary contact structures in each contact set to compensate for the tolerance in the movement of the movable contact. By utilizing individual drive gear sets, the backlash in each gear set is isolated to each particular phase of the tap changer and therefore does not affect or add to the backlash of the other gear sets. Thus, the stationary contact structures can be reduced in size since the movement of the movable contacts is more precise. Furthermore the 20:1 gear ratio between the worm and worm gear reduces any backlash present to 1/20th of its original amount, thereby providing even more precise movement.

These factors result in a no-load tap changer that is constructed of smaller and lighter components which makes it superior in both size and weight over prior art tap changers. In particular, a tap changer, constructed according to the teachings of this invention, has such a small vertical dimension, that is, the distance between the bottom of the mounting board and the top of the stationary contacts, that it may be placed along the side of the core and coil assembly of the transformer without consuming a considerable amount of space within the transformer enclosure. The novel use of individual drive mechanisms enables the plane of rotation of the movable contact assemblies to be placed parallel to the side of the transformer core and coil assembly which provides additional economies. In core type transformers, it is convenient to bring the tap leads out of the middle or side of the core and coil assembly. By utilizing a no-load tap changer, constructed according to the teachings of this invention, the distance between the side of the core and the stationary contacts of the tap changer is minimized, thereby reducing or completely eliminating the cables normally required between the short tap leads and the stationary contacts of the tap changer.

An obvious advantage of a reduction in the size of the tap changer is the resulting decrease in the size and weight of the transformer itself. Not only is a savings realized in the amount of oil coolant required, but also the support structure for the tap changer can be reduced in size. For example, in a 80MVA 138 KV three-phase transformer, approximately 12 inches were eliminated from the width of the transformer enclosure by utilizing a no-load tap changer constructed according to the teachings of this invention, in place of a prior art type of no-load tap changer wherein the plane of rotation of the movable contacts was perpendicular to the side of the core and coil assembly of the transformer. This size reduction reduces the amount of oil coolant required to fill the enclosure by 1,400 gallons and further eliminates about 1,500 pounds of structure necessary to support the previously larger tap changer and enclosure. Additional economies are realized by the elimination of 94 feet of cable between the tap leads and the stationary contacts, as described previously, and the reduced labor, construction time and shipping costs due to the fewer number of separate parts and operations involved in constructing such a tap changer and transformer.

It will be apparent to one skilled in the art, that there has been disclosed a transformer utilizing a small, economical no-load tap changer. By the novel use of individual drive gear sets at each phase of the tap changer to rotate the movable contacts between engagement of successive stationary contacts, a significant reduction in the size of the tap changer is achieved. The smaller size of the tap changer provides additional economies in the transformer itself, especially by reducing the amount of oil coolant, support structure, cables and labor previously required to construct a three-phase transformer using a no-load tap changer.

What is claimed is:

1. An electrical transformer comprising:

a sealed enclosure;

first, second and third electrical windings each formed of a plurality of turns disposed about a longitudinal axis, said first, second and third electrical windings disposed in said enclosure with their respective longitudinal axes aligned in a common plane;

said first, second and third electrical windings disposed in inductive relation with a three-phase magnetic core disposed within said enclosure;

each of said first, second and third windings having tapped winding sections with tap leads connected thereto;

insulating means having generally planar exterior surfaces; said insulating means disposed in said enclosure with said planar surfaces substantially parallel to said common plane and spaced laterally from and within the axial extent of said first, second and third windings;

first, second and third contact sets affixed to said insulating means, each of said contact sets containing a plurality of stationary contacts arranged in an arcuate pattern and equidistant from an axis of rotation; said stationary contacts connected to respective tap leads of said first, second and third windings;

first, second and third movable contacts pivotally mounted on said insulating means and adapted for making electrical connection with respective stationary contacts of said first, second and third contact sets;

first, second and third drive means; said first, second and third drive means having said first, second and third movable contacts, affixed thereto, respectively; said first, second and third drive means operative to rotate said first, second and third movable contacts, respectively, through sequential engagement with successive stationary contacts of said first, second and third contact sets;

operating means mounted outside of said enclosure; and first, second and third connecting means, operative to couple said first, second and third drive means to said operating means such that movement of said operating means causes simultaneous movement of said first, second and third drive means.

2. The transformer of claim 1 wherein the first, second and third drive means each includes reducing means such that the amount of angular rotation of the first, second and third movable contacts is proportionately smaller than the amount of angular rotation of the operating means.

3. The transformer of claim 1 wherein each of the first, second and third drive means consists of a meshing worm and worm gear with said worm being coupled to the respective connecting means and said respective movable contact being affixed to said worm gear.

4. The transformer of claim 3 wherein the angular speed ratio of each worm to each respective worm gear is greater than 1:1; such that angular rotation of each worm causes a proportionately smaller amount of angular rotation of each respective worm gear.

5. The transformer of claim 3 wherein the first, second and third worms and the first, second and third connecting means are aligned along a common axis.

6. An electrical transformer, comprising:

a sealed enclosure;

first, second and third electrical windings each formed of a plurality of turns disposed about a longitudinal axes, said first, second and third electrical windings disposed in said enclosure with their respective longitudinal axis aligned in a common plane;

said first, second and third electrical windings disposed in inductive relation with a three-phase magnetic core disposed within said enclosure;

said first, second and third windings having tapped winding sections with tap leads connected thereto;

first, second and third insulating members, each having generally planar exterior surfaces; said first, second and third insulating members disposed in said enclosure with said planar surfaces substantially parallel to said common plane and spaced laterally from and within the axial extent of said first, second and third windings;

first, second and third contact sets, each including a plurality of stationary contacts arranged in an arcuate pattern and equidistant from an axis of rotation and attached to said first, second and third insulating members, respectively with all of said stationary contacts being aligned substantially in the same plane; said stationary contacts being connected to respective tap leads of said first, second and third windings;

first, second and third movable contacts pivotally mounted from said first, second and third insulating members, respectively, and adapted for making electrical connection with respective stationary contacts of said first, second and third contact sets;

first, second and third drive means, each comprised of first, second and third worm and worm gears, respectively;

said first, second and third worm gears having said first, second and third movable contacts affixed thereto, respectively; said first, second and third worm gears being operative to rotate said first, second and third movable contacts between successive stationary contacts in said first, second and third contact sets, respectively;

said first, second and third worms having threads which mesh with the teeth of said first, second and third worm gears, respectively, with the angular speed ratio of each worm to each respective worm gear being between about 12:1 to about 20:1, such that the angular rotation of each worm causes a proportionately smaller amount of angular rotation of each worm gear;

an operating handle mounted outside of said enclosure; and first, second and third connecting means disposed along a common axis and coupling said first, second and third worms to said operating handle, such that rotation of said operating handle causes simultaneous rotation of said first, second and third worms.

7. The transformer of claim 6 wherein the first, second and third contact sets and the first, second and third movable contacts are mounted from a first side of the first, second and third insulating members, respectively;

said first, second and third worm and worm gears being mounted from a second side of said first, second and third insulating members, respectively.

* * * * *